United States Patent [19]

Swartzendruber

[11] Patent Number: 5,048,154

[45] Date of Patent: Sep. 17, 1991

[54] HOOD HINGE

[75] Inventor: James A. Swartzendruber, West Bend, Wis.

[73] Assignee: Deere & Company, Moline, Ill.

[21] Appl. No.: 549,887

[22] Filed: Jul. 9, 1990

[51] Int. Cl.[5] ..... E05D 7/10

[52] U.S. Cl. ..... 16/267; 16/260

[58] Field of Search ..... 16/267, 260, 261, 358

[56] References Cited

U.S. PATENT DOCUMENTS

| | | | |
|---|---|---|---|
| 822,648 | 6/1906 | Carter | 16/260 |
| 980,577 | 1/1911 | Weingardt | 16/267 |
| 2,334,951 | 11/1943 | Parke et al. | 16/260 |
| 3,567,065 | 3/1971 | Dinse | 16/261 |
| 4,437,529 | 3/1984 | Fralish | 16/374 |
| 4,584,589 | 4/1986 | Bivins et al. | 16/358 |
| 4,805,264 | 2/1989 | Benning et al. | 16/267 |

*Primary Examiner*—Robert L. Spruill
*Assistant Examiner*—Carmine Cuda

[57] ABSTRACT

A hinge for removably securing the rear portion of a hood to a powered vehicle. A rod fixed with the hood is pivotally received by a hooked portion of a mounting member fixed to the vehicle. A protruding member fixed to the hood is positioned beneath a finger portion of the mounting member for preventing the rear portion of the hood from shifting vertically during operation on irregular or bumpy ground conditions. When opened, a limiting member abuts the lower portion of the mounting member. The hood is removed from the vehicle when the hood is partially opened by shifting the rod through an opening in the hooked portion.

7 Claims, 2 Drawing Sheets

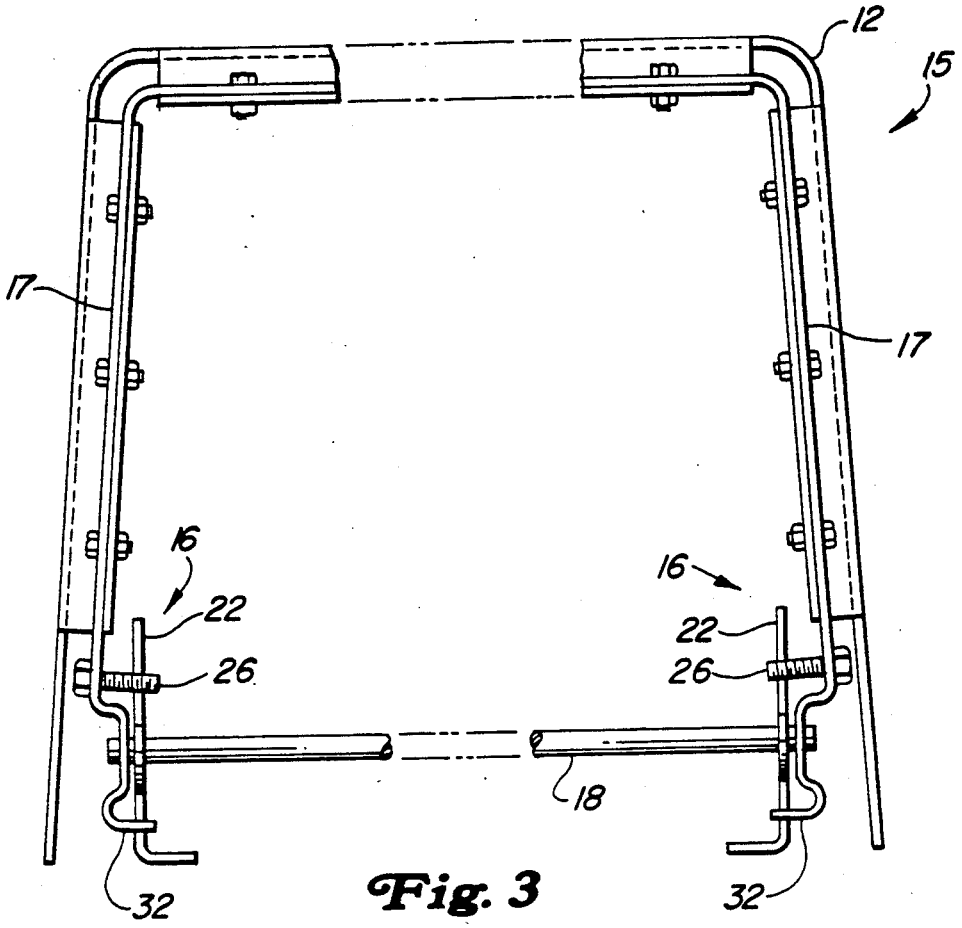
Fig. 3
Fig. 4
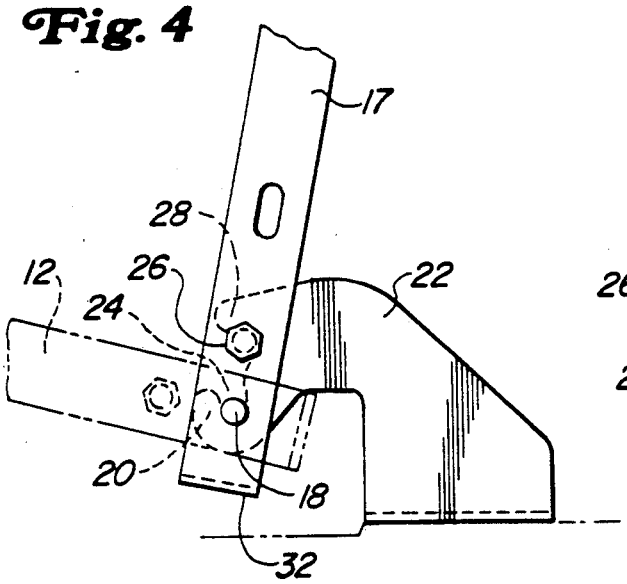
Fig. 5
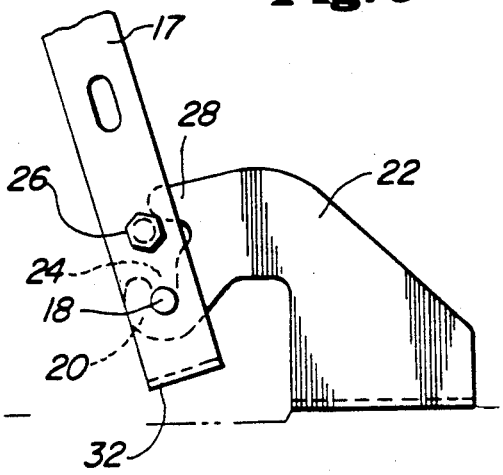

HOOD HINGE

BACKGROUND OF THE INVENTION

1. Field of the Invention

The invention relates to hinges for removably securing a hood, to a powered vehicle such as a lawn mowing vehicle.

2. Description of the Related Art

Many conventional powered mowing vehicles provide hoods that are connected by hinges to the vehicle. The hoods can be opened by releasing a latch at the front of the hood and then lifting and pivoting the hood about the hinge at the rear of the hood to allow access to the internal workings of the vehicle.

As a conventional hood is opened, its center of gravity passes over and beyond the hinge. Therefore, when the hood is in a fully opened position the hood's weight will tend to maintain the hood in the open position, and the hood will not slam shut. It is known to provide a mechanism for limiting the range of pivoting of the hood when in a fully opened position. Cables have been provided for limiting the range of pivoting of the hood when fully open. The hoods are thereby prevented from being damaged by contact with the vehicle frame or the ground. However, these limiting mechanisms can add significant costs to the manufacture of the hood, since additional hardware such as cables must be installed.

Many conventional mowers allow the operator to entirely remove the hood from the vehicle to provide greater exposure of the engine and the other mechanisms otherwise covered by the hood. However, the operator may have to remove hardware from conventional hinge mechanisms in order to remove the hood. This may be time consuming and may require the use of tools. The hardware removed may be lost or misplaced, and the requirement of tools may be inconvenient and prevent repairs at job sites remote from locations where tools are kept.

Therefore, it would be desirable to provide a hinge mechanism for securing a hood to a vehicle that allows the hood to be pivoted to an open position wherein the weight of the hood tends to maintain the hood in the open position, and that limits the range of pivoting in the open position in a manner inexpensive to manufacture. Further, it would be desirable for such a hinge to allow complete removal of the hood without the need for removal of hardware or the use of tools.

SUMMARY OF THE INVENTION

The present invention provides a hinge for removably coupling a hood to a vehicle. A rod means is fixed to the hood and is pivotally carried by a hooked portion of a mounting member carried by the vehicle. The hood pivots about the axis of the rod means between opened and closed positions. In the closed position a protruding member fixed to the hood is positioned beneath a finger portion of the mounting member. The finger portion blocks upward movement of the protruding member when the vehicle encounters rough terrain. To open the hood the operator releases a conventional latch at the front of the hood and lifts up on the front portion of the hood. The hood thereby pivots about the axis of the rod means, and the center of gravity of the hood passes over the axis. Therefore, the weight of the hood in the open position acts to keep the hood from closing. When in the open position a limiting member fixed to the hood abuts the bottom of the hooked portion and prevents the hood from rotating further about the axis of the rod means. The present invention therefore eliminates the need for cables or other mechanisms that are costly to install that serve to limit the pivoting of the hood in the open position. The hood can be removed from the vehicle for greater access to the power source by partially opening the hood and lifting the hood upwardly and rearwardly.

The present invention therefore provides a hinge for securing a hood to a vehicle during operation over rough terrain. The hinge according to the present invention allows the hood to be removed without requiring the use of tools or the removal of hardware. When in the open position the weight of the hood acts to keep the hood from closing. Also, a limiting member acts to block further pivoting of the hood when in the open position in a manner that is inexpensive to manufacture.

BRIEF DESCRIPTION OF THE DRAWINGS

FIG. 3 shows a rear view of the preferred embodiment of the present invention.

FIG. 4 shows a partial side view of the hinge with the hood closed in solid lines, and the hood in the open position shown in phantom.

FIG. 5 shows a partial side view of the hinge mechanism in a partially open position.

DESCRIPTION OF THE PREFERRED EMBODIMENT

Figure 1:
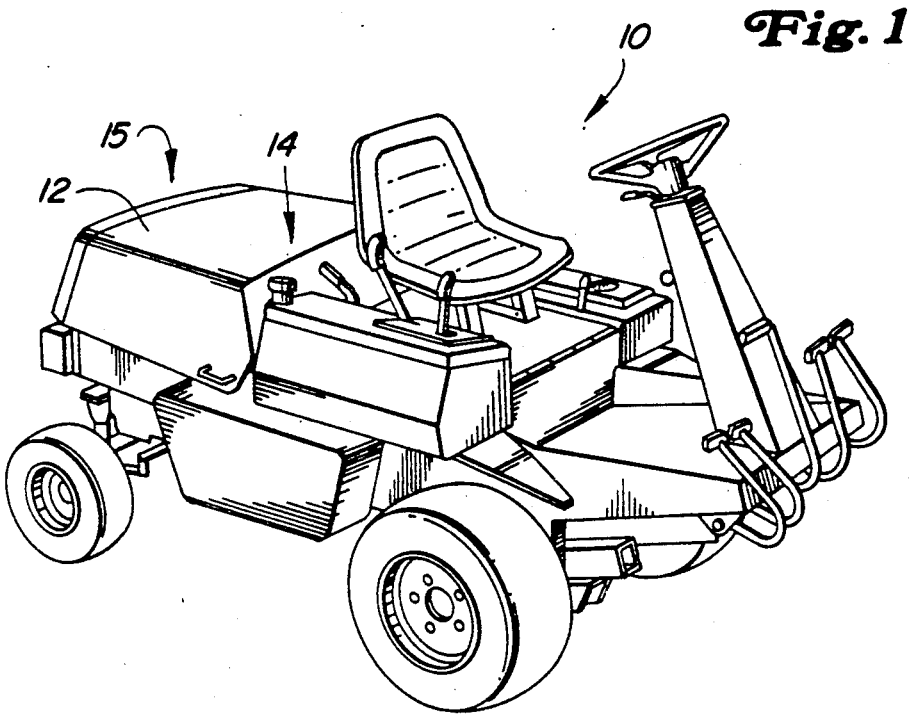
FIG. 1 illustrates a powered vehicle as used with the present invention.

In the preferred embodiment of the present invention and as shown in FIG. 1, a powered vehicle 10 such as a riding lawn mower is provided with a hood 12, having front and rear portions 14, 15. A hinge mechanism 16, as shown in FIGS. 2–5, is provided at the rear of the vehicle 10 and serves to couple the hood 12 with the vehicle 10. A bracket 17 is carried within the hood's rear portion 15. The preferred embodiment includes a rod means 18 that is rigidly fixed to and extends laterally between the outer sides of the bracket 17. The rod means 18 is pivotally carried by a hooked portion 20 of a mounting member 22 that is fixed to the rear of the vehicle 10. The hood 12 pivots about the axis of the rod means 18 carried within the hooked portion 20 as the hood 12 is opened and closed. The hooked portion 20 defines an opening 24 through which the rod means 18 may pass so that the operator can remove the hood 12 from the vehicle 10.

A protruding member or bolt 26, as seen in FIGS. 2–5, is fixed to the bracket 17 and is positioned immediately beneath a finger portion 28 of the mounting member 22 when the hood 12 is in the closed position. The finger 28 prevents the protruding member 26, and therefore the rear portion 15 of the hood 12, from swinging upwardly during operation. A limiting member 32 is fixed to the hood 12 and abuts the underside of the mounting member 22 when the hood 12 is in its fully opened position, thereby preventing the hood 12 from further pivoting about the axis of the rod means 18. A resilient latch 34 fixed to the vehicle 10 acts to releasably secure the hood's front portion 14 to the vehicle 10.

Figure 2:
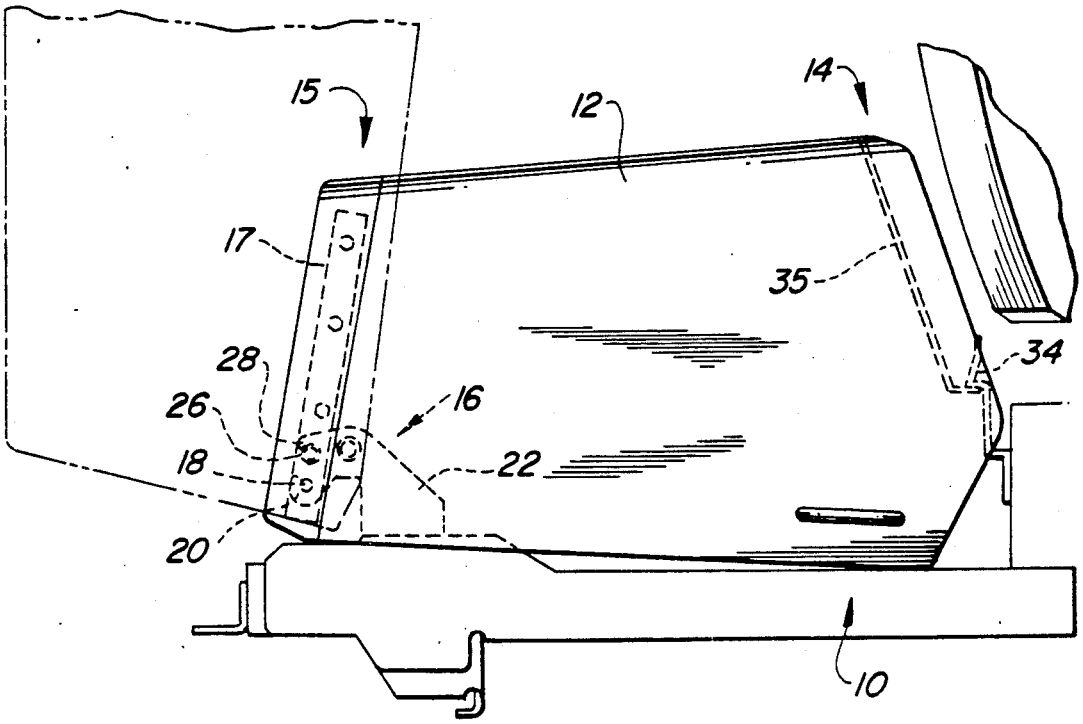
FIG. 2 shows a side view of the present invention with the hood closed in solid lines, and the hood in an open position shown in phantom.

Next, the operation of the preferred embodiment of the present invention will be described. FIGS. 2 and 4 illustrate the hinge mechanism 16 when the hood 12 is in the closed position. The rod means 18 is positioned within the hooked portion 20. The rear portion 15 of the hood 12 is thereby carried by the mounting member 22. The protruding member 26 is positioned directly beneath the finger portion 28 of the mounting member 22. When the vehicle 10 encounters rough terrain with the hood 12 in the closed position as shown in FIG. 2, the rear portion 15 of the hood 12 is prevented from shifting upwardly, since the finger portion 28 will engage the protruding member 26 to block upward movement. The rear portion 15 of the hood 12 is therefore vertically constrained when the hood 12 is fully closed, since the protruding member 26 and rod means 18 are confined between the hooked portion 20 and the finger portion 28 of the mounting member 22. Horizontal fore and aft movement is also restricted, since the hooked portion 20 of the mounting member 22 confines fore and aft movement of the rod means 18. The hood 12 is prevented from pivoting about the axis of the rod means 18 by the latch 34 that vertically confines the front portion 14 of the hood 12 against the vehicle 10.

When the operator wishes to open the hood 12 he presses forwardly on the top portion of the latch 34 to swing it away from contact with hood member 35 and release the hood's front portion 14. The operator then lifts up the front portion 14 of the hood 12 to pivot the hood 12 about the axis of the rod means 18. As the hood 12 pivots, the center of gravity of the hood 12 pivots upwardly and rearwardly, and eventually passes over the axis of the rod means 18 as shown in phantom in FIG. 2. The hood 12 continues to pivot after the center of gravity passes over the axis, and comes to rest when the limiting member 32 abuts the lower side of the mounting member 22 as shown in phantom in FIG. 4. Since the center of gravity is on the side of the rod means' axis that the fully opened position is on, the weight of the hood 12 keeps the hood 12 open. The limiting member 32 abuts the mounting member 22 to prevent the hood 12 from further rotating about the axis of the rod means 18.

The hood 12 can also be fully removed from the vehicle 10. When the hood 12 is pivoted to become partially opened, as shown in FIG. 5, the protruding member 26 is not directly beneath the finger portion 28 and therefore is not vertically confined by the finger portion 28. The rear portion 30 of the hood 12 can therefore be lifted, and the rod means 18 moved through the opening 24 in the hooked portion 20. As the operator lifts the rear portion 15 the limiting member 32 engages the bottom of the hooked portion 20 and blocks the removal of the hood 12. Therefore, the hood 12 must be moved rearwardly in order for the limiting member 32 to clear the hooked portion 20. Once the operator has moved the hood 12 rearwardly as described above, the hood 12 is fully removed from the hinge 16 and vehicle 10.

I claim:

1. A hinge for removably securing a hood to a powered vehicle, said hood having open, partially open and closed positions, comprising:

rod means rigidly fixed to the hood, said rod means defining a single axis about which the hood pivots when shifting between positions;

a protruding member fixed to the hood;

a mounting member fixed to the powered vehicle for mounting the hood to the vehicle, said mounting member including a hooked portion for pivotally carrying the rod means and blocking horizontal shifting of the rod means, said hooked portion having an opening through which the rod means passes to remove the hood from the vehicle when the hood is in the partially open position, and a finger portion for blocking the upward movement of the protruding member to prevent the rod means from passing through the opening of the hooked portion when the hood is in the closed position.

2. The invention of claim 1, wherein the rod means includes a rod positioned below the protruding member, said rod means and protruding member being carried between and vertically confined by the hooked portion and the finger portion of the mounting member when the hood is in the closed position.

3. The invention of claim 1, further comprising a limiting member fixed with the hood for engaging the mounting member when the hood is in the fully open position to prevent the hood from rotating further about the axis of the rod means.

4. The invention of claim 1, wherein the weight of the hood in the closed position biases the hood to rotate about the axis of the rod means toward the closed position and the weight of the hood in the fully open position biases the hood to rotate about the axis of the rod means toward the open position.

5. The invention of claim 1, wherein the protruding member further comprises a bolt carried by the hood.

6. A hinge for removably securing a hood to a powered vehicle, said hood having open, partially open and closed positions, comprising:

rod means rigidly fixed to the hood, said rod means defining a single axis about which the hood pivots when shifting between positions;

a protruding member fixed to the hood;

a generally J-shaped mounting member fixed to the powered vehicle for mounting the hood to the vehicle, said mounting member including a hooked portion formed in the lower portion of the mounting member for pivotally carrying the rod means and blocking horizontal shifting of the rod means, said hooked portion having an opening through which the rod means shifts upwardly to remove the hood from the vehicle when the hood is in the partially open position, and a horizontally extending finger portion positioned above the protruding member for blocking the upward movement of the protruding member to prevent the rod means from passing upwardly through the opening of the hooked portion when the hood is in the closed position.

7. The invention of claim 6, wherein a gap is formed between the finger portion and the hooked portion, and through which the rod means and protruding portion pass as the hood is removed from the vehicle.

* * * * *